United States Patent [19]

Lefeber

[11] Patent Number: 4,967,835

[45] Date of Patent: Nov. 6, 1990

[54] FILTER FIRST DONUT OIL COOLER

[75] Inventor: Thomas E. Lefeber, Kenosha, Wis.

[73] Assignee: Modine Manufacturing Company, Inc., Racine, Wis.

[21] Appl. No.: 396,279

[22] Filed: Aug. 21, 1989

[51] Int. Cl.[5] ..... F28F 3/08

[52] U.S. Cl. ..... 165/167; 165/916

[58] Field of Search ..... 165/167, 916

[56] References Cited

U.S. PATENT DOCUMENTS 3,743,011 7/1973 Frost ..... 165/167

4,360,055 11/1982 Frost ..... 165/167 X 4,580,625 4/1986 Yamanaka ..... 165/167

*Primary Examiner*—Robert G. Nilson

*Attorney, Agent, or Firm*—Wood, Phillips, Mason, Recktenwald & VanSanten

[57] ABSTRACT

Areas of potential oil stagnation in a donut oil cooler that lower heat transfer efficiency are avoided by locating closed fluid flow passages (100) for unfiltered oil to be directed to a filter (14) within spacers (102), (110), (130), and defined by corresponding apertures (88), (90), (92), (94) in plates (78) and (80) forming oil cooling chambers (76) and located centrally thereof.

6 Claims, 4 Drawing Sheets

FILTER FIRST DONUT OIL COOLER

FIELD OF THE INVENTION

This invention relates to heat exchangers and, more particularly, to heat exchangers of the so-called "donut" type that are useful as oil coolers in vehicular applications.

BACKGROUND OF THE INVENTION

While the use of heat exchangers to cool lubricating oil employed in an internal combustion engine has long been known, the invention of the so-called "donut" oil cooler by Donald J. Frost as exemplified in his U.S. Letters Pat. No. 3,743,011 issued July 3, 1973 began a whole new era of vehicular oil coolers. Through Frost's invention, for the first time, it was possible to readily adapt a lubricating oil system of an internal combustion engine to include an oil cooler. Donut oil coolers of the Frost type have an axial length of only a couple of inches or less and are constructed so that, with the assistance of an adapter or pipe, they may be interposed between the engine block and the oil filter, being attached directly to the block in the location formerly occupied by the oil filter. All else that need be done is to connect to coolant ports on the housing of the donut oil cooler into the vehicular cooling system which is simply accomplished with hoses.

Donut oil coolers of this type typically include a housing which is connected to receive coolant and which contains a stack of relatively thin, disc-like chambers through which the oil to be cooled is circulated. In terms of plumbing, such oil coolers may be located upstream of the filter, in which case they are cooling dirty oil, or downstream of the filter, in which case they are cooling clean oil. Because such donut oil coolers typically include turbulators within the chambers through which the oil is circulated, it is most advantageous that they be located downstream of the filter to cool clean oil so that there is a lesser tendency of the turbulators to be gummed up by dirty oil to impede the flow of oil, and thus heat transfer, on the oil side of the oil cooler.

In the above-identified patent to Frost, there is disclosed a means whereby oil to be cooled from the engine may be passed through closed passages within the oil cooler directly to the filter for filtering therein prior to being admitted to the oil receiving chambers that are in heat exchange relation with the engine coolant. As disclosed in the Frost patent, these passages are located radially outwardly of the center of the oil cooler, but somewhat radially inwardly of the periphery of the disc-like chambers. As a consequence, there exists a small volume between the peripheries of the chambers and the closed passageways for the oil enroute to the filter which are subject to stagnation. As is well known, turbulence plays a significant part in the rate of heat transfer between fluids. Thus, where areas of stagnant fluid exist, heat transfer is considerably reduced from what would occur if more turbulent flow was present.

The present invention is directed to providing a donut oil cooler of the type wherein the oil is flowed first through the oil filter so that the cooling of the oil is performed on cleaned oil and wherein areas of stagnation are avoided to maximize heat transfer efficiency.

SUMMARY OF THE INVENTION

As the principal object of the invention to provide a new and improved heat exchanger of the so-called "donut" type. More specifically, it is an object of the invention to provide such a heat exchanger that can be placed in line with a filter such that flow of a liquid to be cooled first flows through the filter so as to be cleaned prior to the cooling operation, and wherein areas of possible liquid stagnation are eliminated to maximize heat transfer efficiency.

An exemplary embodiment of the invention achieves the foregoing objects in a heat exchanger construction including a housing with an inlet and an outlet for a first heat exchange fluid. A stack of individual chambers are received within the housing and each is adapted to receive a second heat exchange fluid. Spacers are disposed between the chambers of the stack and each includes a central opening and at least first, second and third openings disposed about the central opening. The first openings are in fluid communication with each other and define a closed fluid flow path through the stack. The second openings are in fluid communication with each other and with the interior of the chambers on one side of the central opening. The third openings are in fluid communication with each other and with the interior of the chambers on another side of the central opening. Means are provided to establish fluid communication between the central opening and the second openings adjacent one end of the stack and means are provided for establishing fluid communication between the central opening and the third openings adjacent the opposite end of the stack.

By locating the various openings that define the various flow paths in the spacers about the central opening, a compact arrangement exists wherein no conduits are present in the space between the peripheries of the chambers and the peripheries of the spacers which would allow stagnation of fluid.

In a preferred embodiment of the invention, the second and third openings are diametrically opposite one another about the central opening.

Preferably, there are two of the first openings in each of the spacers and they are located diametrically opposite of one another and between the second and third openings on opposite sides of the central opening.

In one embodiment, the first openings are defined as arcuate slots in close adjacency to the central openings Preferably, the arcuate slots are relatively narrow. The invention contemplates that the chambers be formed of spaced plates sealed to each other about their peripheries, and that the spacers be at least of two sorts. One sort is the type of spacer disposed between the chambers of the stack, and the second sort is a spacer disposed between the plates of each chamber generally centrally thereof.

Other objects and advantages will become apparent from the following specification taken in connection with the accompanying drawings.

DESCRIPTION OF THE PREFERRED EMBODIMENT

Figure 1:
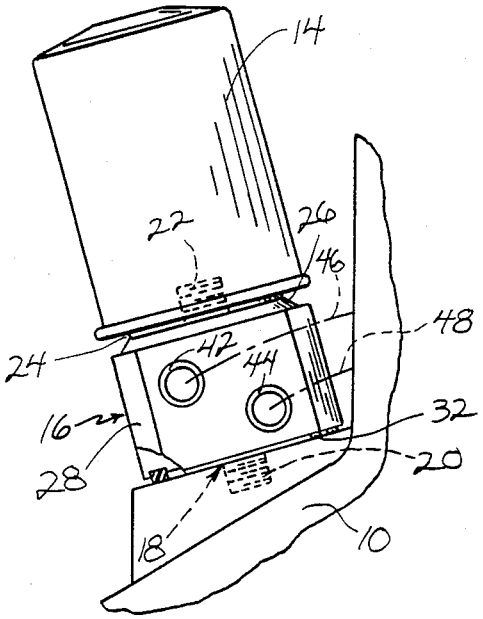
FIG. 1 is an elevational view of a heat exchanger made according to the invention installed on the block of an engine and with an oil filter in place.

An exemplary embodiment of a heat exchanger made according to the invention is described herein and is illustrated in the drawings in connection with an oil cooling function for the lubricating oil of an internal combustion engine. However, it should be understood that the invention may find utility in other applications, and that no limitation to use as an oil cooler is intended except insofar as expressly stated in the appended claims.

With reference to FIG. 1, the block of an internal combustion engine is fragmentarily shown at 10 and includes a seat 12 which is normally adapted to receive an oil filter 14. In the case of the invention, however, a donut oil cooler, generally designated 16, is interposed between the oil filter 14 and the seat 12.

Figure 3:
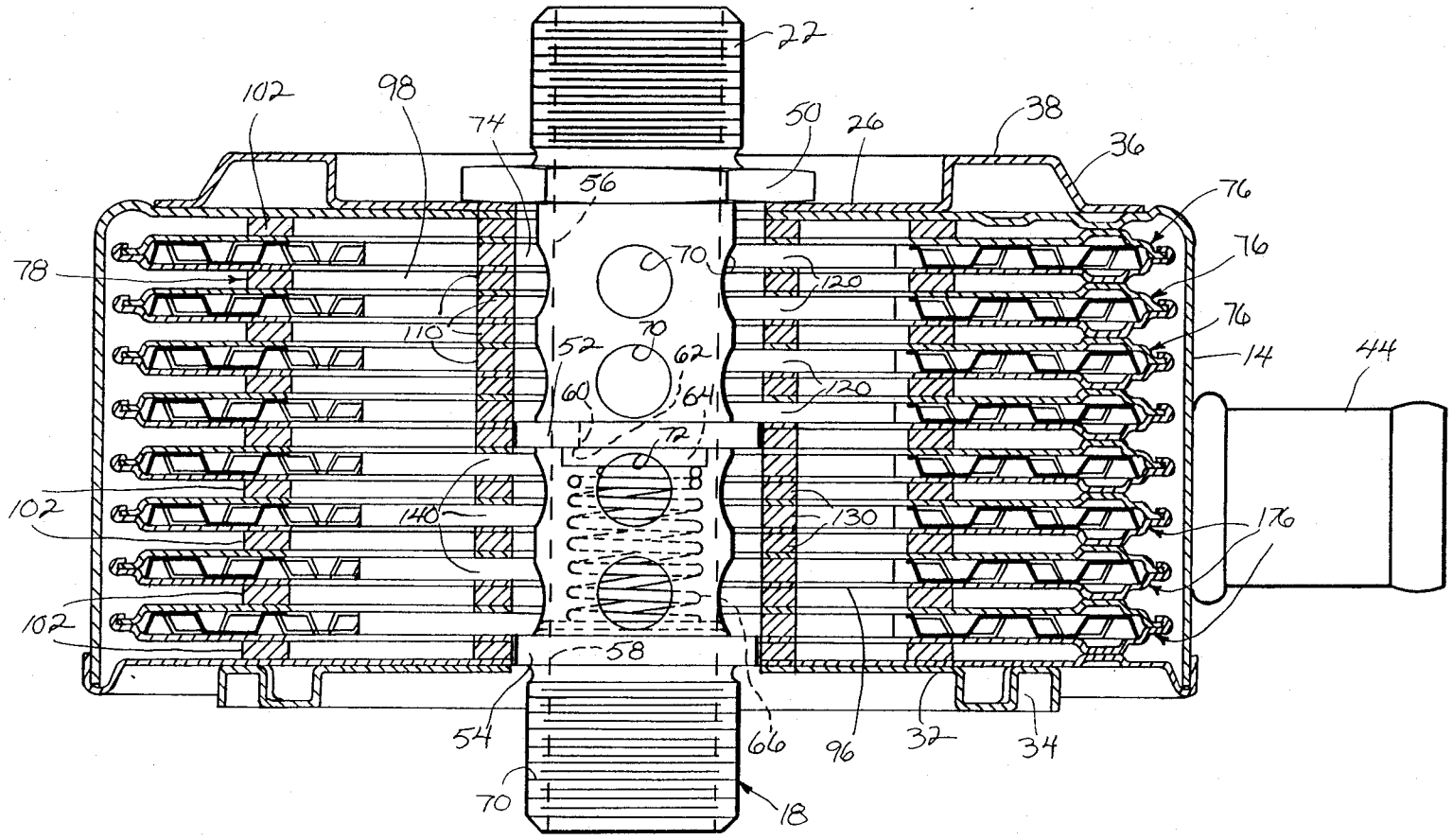
FIG. 3 is an enlarged, sectional view taken approximately along the line 3—3 in FIG. 2 and showing a mounting adapter installed.

More particularly, the heat exchanger 16 is held in sandwiched relation between the filter 14 and the seat 12 by an adapter, generally designated 18 and best shown in FIG. 3. The adapter 18 has one threaded end 20 that is threaded into the oil return port in the seat 12 and an opposite threaded end 22 which is threaded into the central opening of the filter 14.

The seal 24 conventionally carried by the oil filter 14 sealingly engages one face 26 of a housing 28 for the heat exchanger 16. An O-ring seal 30 is interposed between the opposite face 32 of the housing 28 and the seat 12.

Figure 2:
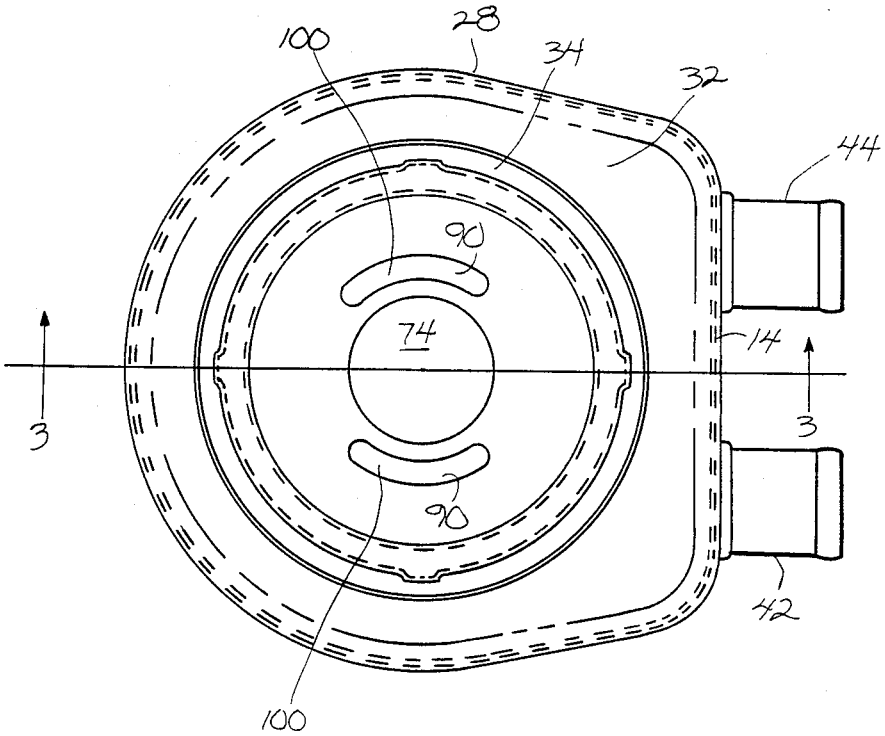
FIG. 2 is a plan view of the heat exchanger.

As best seen in FIGS. 2 and 3, a groove 34 is located in the face 32 for receipt of the O-ring 30. As best seen in FIG. 3, the face 26 includes a circular rib 36 provided with a planar surface 38 which may be engaged by the seal 24 carried by the filter 14.

Also as seen in FIG. 1, 2 and 3, the housing 28 includes, on one side 40, spaced inlet and outlet nipples 42 and 44, respectively, which may be connected by hoses shown schematically at 46 and 48 in FIG. 1 into the coolant system for the internal combustion engine.

Turning now to FIG. 3, the mounting adaptor 18 is seen in greater detail. Adjacent the threaded end 22, the same includes a hexagonal shoulder 50 by which the adapter 18 may be rotated with a suitable wrench to thread the end 20 into the engine block. The shoulder 50 also bears against the face 26 of the housing 28 of the heat exchanger to locate the same in place.

Intermediate its ends, the adapter 18 includes a first shoulder 52 which is approximately midway between the faces 26 and 32 of the housing 28, and a second shoulder 54 which is essentially at or coplanar with the face 32 and which may be sealed with respect thereto by means of an O-ring, or the like (not shown). Alternatively, such a seal may be omitted entirely.

The adapter 18 includes an interior passage 56 that extends from the end 22 to the shoulder 52, as well as an interior passage 58 which extends from the end 20 to the shoulder 52. The passages 56 and 58 are connected by a reduced diameter passage 60 such that an interior shoulder 62 faces the passage 58 and serves as a valve seat for a pressure relief valve 64 biased against the shoulder 62 by means of a spring 66 received within the passage 58 and held in place by any suitable means.

The arrangement is such that if the pressure in the passage 56 exceeds a predetermined level, it will act against the valve 64 to cause the same to open so that flow between the passages 56 and 58, which is normally blocked by the valve 64, can occur.

The adapter 18 includes apertures 70 between the shoulders 50 and 52 in fluid communication with the passage 56 and similar apertures 72 between the shoulder 52 and the shoulder 54 in fluid communication with the passage 58.

As seen in FIG. 3, the adapter is located in a central passageway 74 that extends between the faces 26 and 32. The shoulder 52 relatively snugly fits within the passage 74 to act as a baffle purposes to be seen. The same is true of the shoulder 54.

FIG. 3 also illustrates that within the housing 28 of the heat exchanger, there is a stack of chamber units 76. In the illustrated embodiment, there are eight chamber units 76, but those skilled in the art will appreciate that greater or lesser numbers may be used.

The chamber units 76 are formed generally as disclosed in the previously identified Frost patent, the details of which are herein incorporated by reference. For present purposes, a single representative chamber unit 76 as illustrated in FIGS. 4 and 5 and as seen to include two spaced plates 78 and 80, typically formed of metal such as stainless steel, clinched as at 82 on their peripheries to be sealed thereat.

A turbulator 84 of the type disclosed in the previously identified Frost patent is located between the plates 78 and 80 and a spacer 86 which may be one of two types depending upon the location of the chamber 76 within the stack housing 28 is similarly centrally located between the plates 78 and 80.

Figure 4:
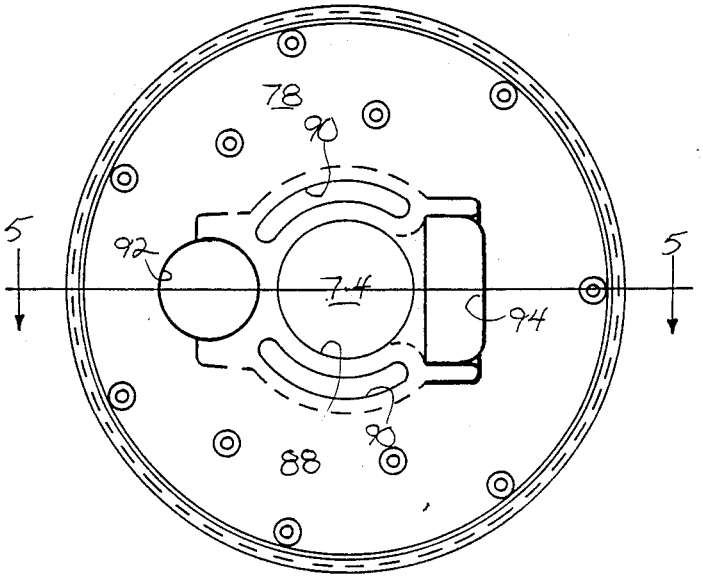
FIG. 4 is a plan view of an individual chamber used in the heat exchanger.
Figure 5:
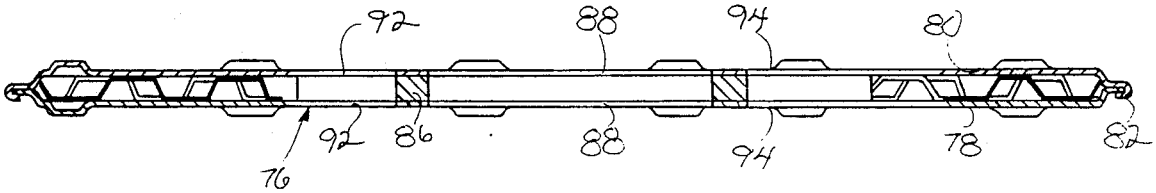
FIG. 5 is an enlarged, sectional view taken approximately along the line 5—5 in FIG. 4.

With reference to FIG. 4, the plates 78 and 80 (only the plate 78 is shown) each include a central opening 88 which in part defines the central passage 74. In close proximity to the central openings 88 and spaced thereabout are first openings 90, second openings 92 and third openings 94. The first openings 90 are paired on diametrically opposite sides of the central opening 88 and are in the form of narrow, arcuate slots concentric with the central opening 88. The openings 92 and 94 are on opposite sides of the central opening 74 and located so as to separate the first openings 90 of each pair.

Returning to FIG. 3, the second openings 92 define a passage 96 between the interior surfaces of the faces 26 and 32 while the third openings 94 define a passage 98 diametrically opposite from the passage 96, and also extending between the interior surfaces of the faces 26 and 32. The first openings define similar, closed passageways 100 (FIG. 2) that extend between and emerge at the faces of 26 and 32.

Figure 6:
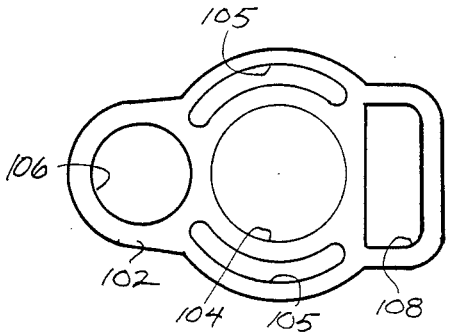
FIG. 6 is a plan view of one type of spacer utilized in the heat exchanger.

In addition to the openings in the plates defining the passages 74, 96, 98 and 100, holes or openings in the spacers are also employed. Three types of spacers are used. A first type of spacer 102 is located between chamber units 76 forming the stack. This spacer 102 is illustrated in FIG. 6 and is seen to include a central opening 104 alignable with the openings 88 in the plates 78 and 80, diametrically opposed, arcuate and slot-like first openings 105 alignable with the openings 90, a second opening 106 alignable with the openings 92, and a third opening 108 alignable with the openings 94. It is to be particularly observed that each of the openings 104, 105, 106 and 108 are completely surrounded by the body of the spacer 102.

Figure 7:
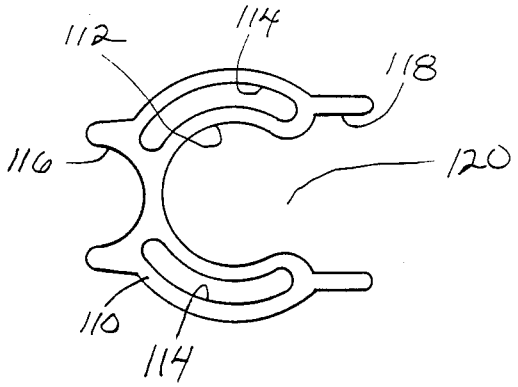
FIG. 7 is a plan view of another type of spacer used in the heat exchanger.

The four chamber units 76 adjacent the end of the heat exchanger represented by the face 26 include internal spacers 110 of the configuration illustrated in FIG. 7. Again, there is a central opening 112 alignable with the openings 88 in the plates 78 and 80, diametrically opposed first openings 114 which are narrow, slot-like and arcuate and alignable with the openings 90; a second opening 116 alignable with the openings 92; and a third opening 118 alignable with the openings 94. It is to be observed that both the second and third openings 116 and 118 are not fully closed, but open radially outwardly toward the turbulator received between the plates between which the spacer 110 is also located. It will further be observed that a passage 120 interconnects the central opening 112 with the third opening 118, respectively, in the spacer 110. As can be appreciated from FIG. 3, the passage 120 connecting the central opening 112 with the third opening 118 in the spacers 110 establishes fluid communication between the interior of the four uppermost chamber units 76 and that part of the passage 74 above the shoulder 52.

Figure 8:
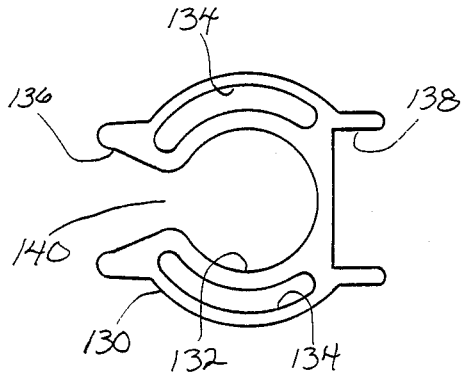
FIG. 8 is a plan view of still a third type of spacer used in the heat exchanger.

The four chamber units 76 most nearly adjacent to face 32 include internal spacers 130 of the configuration illustrated in FIG. 8. The spacer 130 includes a central opening 132 alignable with the central openings 88 in the plates 78 and 80, diametrically opposed first openings 134 which are narrow, arcuate and slot-like, and alignable with the openings 90; a second opening 136 alignable with the openings 92 and a diametrically opposite third opening 138, alignable with the openings 94. Again, the second and third openings 136 and 138, respectively, are open on the radially outward side to open towards the turbulators within the chamber units 76 at the bottom of the stack. In addition, a passage 140 interconnects the central opening 132 in the spacer 130 with the second opening 136. As can be seen in FIG. 3, this places the passage 98 in fluid communication with that part of the passage 74 below the shoulder 52.

In operation, oil to be filtered is directed out of the block 10 by the oil pump (not shown) associated with the engine through conventional ports located radially outward of that receiving the threaded end 20 of the adapter 18, but inward of seal 30. As can be appreciated from FIG. 2, such oil will pass into the passages 100 and entirely through the heat exchange unit 16 into the ports in the filter 14 (not shown) radially outward of the threaded end 22 but radially inward of the seal 24. The uncooled, unfiltered oil will then pass through the filter 14 and be filtered thereby and directed out of the filter 14 in a conventional fashion into the threaded end 22 of the adapter 18. From there, it will flow into the passage 56 until blocked by the valve 64. It will exit the internal passage 56 within the adapter 18 via the apertures 70 and thereby flow into the portion of the passage 74 above the shoulder 52. From there, it will pass through the passages 120 in the spacers 110 internal to each of the upper four chamber units 76.

The oil will also enter the passage 96 via the passages 120 in the four uppermost chamber units 76 and descend within the passage 96 to the four lower chamber units 76. In the case of all of the chamber units 76, the oil will pass through the turbulators and around the central spacers to enter the passage 98 via either the open ends of the openings 118 in the spacers 110, or the openings 138 in the spacers 130.

Once in the passage 98, the oil may flow downwardly within the stack, as viewed in FIG. 3, until reaching the passages 140 in the spacers 130 located internally of the four lowermost chamber units 76. From this location, the oil may then flow into that part of the central passage 74 below the shoulder 52 and ultimately into the passage 58 via the apertures 72. Once in the passage 58, it may be conducted back, via the threaded end 20, to the low pressure side of the seat 12 within the engine lubricating system.

From the foregoing, it will be readily appreciated that a heat exchanger made according to the invention provides for filtering of the oil prior to the cooling thereof, meaning that only filtered oil will be exposed to the turbulators 84 to minimize the possibility of plugging, or the like. In addition, by locating the passage 100, which provide for flow of the unfiltered oils through the heat exchanger to the filter prior to being filtered, within the centrally located spacers and central locations within the plates making up the chamber units 76, as contracted to radially outer locations as disclosed in the previously identified Frost patent, stagnant areas as within the oil flow path are completely avoided. Consequently, heat transfer is maximized.

Those skilled in the art will also appreciate that in contrast to the heat exchanger disclosed in the previously identified Frost patent, the present invention provides for single pass flow of the oil rather than two pass flow of the oil to the heat exchanger. This in turn has resulted in better performance than that can be obtainable with the construction made according to the Frost patent.

In addition, a heat exchanger made according to the invention disclosed herein is structurally stronger than that disclosed in the Frost patent, since all fluid passages for the oil are formed in the spacers rather than in relatively thin, stamped embossments or the like in the plates as disclosed by Frost. Consequently, a heat exchanger made according to the invention can withstand higher oil pressures.

What is claimed is:

1. A heat exchanger comprising:

a housing including an inlet and an outlet for a first heat exchange fluid;

a stack of chambers received within said housing and each adapted to receive a second heat exchange fluid;

spacers disposed between the chambers of the stack, each including a central opening and at least first, second and third openings disposed about said central opening;

said first openings being in fluid communication with each other and defining a closed fluid flow path through said stack;

said second openings being in fluid communication with each other and with the interiors of said chambers on one side of said central opening;

said third openings being in fluid communication with each other and with the interiors of said chambers on another side of said central opening;

means establishing fluid communication between said central opening and said second openings adjacent one end of said stock; and means establishing fluid communication between said central openings and said third openings adjacent the opposite end of said stack.

2. The heat exchanger of claim 1 wherein said second and third openings are diametrically opposite one another about said central opening.

3. The heat exchanger of claim 2 wherein there are two of said first openings in said spacers located diametrically opposite of one another, and between said second and third openings on opposite sides of said central opening.

4. The heat exchanger of claim 3 wherein said first openings are defined by arcuate slots in close adjacency to said central openings.

5. A heat exchanger comprising:

a housing including an inlet and an outlet for a first heat exchanger fluid;

a stack of chambers received within said housing and each adapted to receive a second heat exchange fluid, each chamber being defined by two spaced plates sealed to each other about their peripheries;

first spacers disposed between the chambers of the stack; and second spacers between the plates of each chamber generally centrally thereof;

each of said plates and said spacers including aligned central openings and at least aligned first, second and third openings disposed about said central opening;

said first openings being in fluid communication with each other and defining a closed fluid flow path through said stack;

said second openings being in fluid communication with each other and with the interiors of said chambers on one side of said central openings;

said third openings being in fluid communication with each other and with the interiors of said chamber on another side of said central openings;

openings in said second spacers at one end of said stack extending between said central openings and said second openings; and additional openings in said second spacers at the other end of said stack extending between said central openings and said third openings.

6. A heat exchanger comprising:

a housing including an inlet and an outlet for a first heat exchanger fluid;

a stack of chambers received within said housing and each adapted to receive a second heat exchange fluid, each chamber being defined by two spaced plates sealed to each other about their peripheries;

first spacers disposed between the chambers of the stack; and second spacers between the plates of each chamber generally centrally thereof;

each of said plates and said spacers including aligned central openings and first, second and third openings disposed about said central opening;

said first openings being narrow, arcuate slots concentric with said central openings and being (a) aligned and paired on opposite sides of said central openings and (b) between said second and third openings and (c) in fluid communication with each other and defining a closed fluid flow path through said stack;

said second openings being aligned and in fluid communication with each other and with the interiors of said chambers on one side of said central openings;

said third openings being aligned and in fluid communication with each other and with the interiors of said chamber on another side of said central openings;

openings in said second spacers at one end of said stack extending between said central openings and said second openings; and additional openings in said second spacers at the other end of said stack extending between said central openings and said third openings.

* * * * *